US010067460B2

(12) United States Patent
Uehara

(10) Patent No.: US 10,067,460 B2
(45) Date of Patent: Sep. 4, 2018

(54) IMAGE FORMING APPARATUS IN WHICH RELATIVE POSITIONAL RELATIONSHIP BETWEEN APPARATUS MAIN BODY FRAME AND FEED DEVICE IS DETERMINED THROUGH FITTING BETWEEN POSITIONING PORTION OF APPARATUS MAIN BODY FRAME AND POSITION TARGET PORTION OF FEED DEVICE

(71) Applicant: KYOCERA Document Solutions Inc., Osaka (JP)

(72) Inventor: Masakazu Uehara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/442,762

(22) Filed: Feb. 27, 2017

(65) Prior Publication Data

US 2017/0261913 A1 Sep. 14, 2017

(30) Foreign Application Priority Data

Mar. 11, 2016 (JP) ..... 2016-047976

(51) Int. Cl.
*G03G 15/00* (2006.01)
*G03G 21/16* (2006.01)
*B65H 1/00* (2006.01)

(52) U.S. Cl.
CPC ..... *G03G 21/1619* (2013.01); *B65H 1/00* (2013.01); *G03G 15/6502* (2013.01)

(58) Field of Classification Search
CPC ..... G03G 21/1619
USPC ..... 399/107
See application file for complete search history.

(56) References Cited

U.S. PATENT DOCUMENTS 5,191,382 A * 3/1993 Okamura ..... G03G 15/6502 271/9.11
5,666,595 A * 9/1997 Sameshima ..... G03G 15/00 24/658
7,203,445 B2 * 4/2007 Uchida ..... G03G 15/6511 292/113
7,817,926 B2 * 10/2010 Yano ..... G03G 15/6502 399/13
8,045,913 B2 * 10/2011 Jeong ..... B41J 29/02 399/110

(Continued)

FOREIGN PATENT DOCUMENTS

JP 2006-047515 A 2/2006

*Primary Examiner* — Quana M Grainger
(74) *Attorney, Agent, or Firm* — Studebaker & Brackett PC

(57) ABSTRACT

An image forming apparatus includes an apparatus main body and a feed device. The feed device is detachably attached to the apparatus main body and feeds a recording medium. The apparatus main body includes an image forming section and a main body frame. The image forming section forms an image on the recording medium. The main body frame supports the image forming section. The main body frame has a first positioning hole and a second positioning hole. The feed device includes positioning protrusions. When the respective positioning protrusions are fitted into the first and second positioning holes, a relative positional relationship between the main body frame and the feed device is determined.

11 Claims, 13 Drawing Sheets

(56) References Cited

U.S. PATENT DOCUMENTS

| | | | | |
|---|---|---|---|---|
| 2007/0212106 | A1* | 9/2007 | Aramata | G03G 21/1647 399/107 |
| 2013/0050382 | A1* | 2/2013 | Okamoto | B41J 29/026 347/108 |
| 2014/0001696 | A1* | 1/2014 | Yoshida | B65H 5/00 271/9.01 |

* cited by examiner

IMAGE FORMING APPARATUS IN WHICH RELATIVE POSITIONAL RELATIONSHIP BETWEEN APPARATUS MAIN BODY FRAME AND FEED DEVICE IS DETERMINED THROUGH FITTING BETWEEN POSITIONING PORTION OF APPARATUS MAIN BODY FRAME AND POSITION TARGET PORTION OF FEED DEVICE

INCORPORATION BY REFERENCE

The present application claims priority under 35 U.S.C. § 119 to Japanese Patent Application No. 2016-047976, filed on Mar. 11, 2016. The contents of this application are incorporated herein by reference in their entirety.

BACKGROUND

The present disclosure relates to image forming apparatuses.

Some image forming apparatus includes an apparatus main body, an image forming section, and a paper feed device. The apparatus main body includes a guide member and a main body frame that supports the image forming section. The paper feed device is detachably attached to the apparatus main body. The guide member is mounted on the main body frame. The guide member has a positioning hole. The paper feed device includes a positioning protrusion. The positioning protrusion is inserted into the positioning hole. Through the above, a relative positional relationship between the main body frame and the paper feed device is determined.

SUMMARY

An image forming apparatus according to the present disclosure includes an apparatus main body and a feed device. The feed device is detachably attached to the apparatus main body and feeds a recording medium. The apparatus main body includes an image forming section and a main body frame. The image forming section forms the image on the recording medium. The main body frame supports the image forming section. The main body frame has a positioning portion. The feed device includes a positioning target portion. When the positioning portion is fitted into the positioning target, a relative positional relationship between the main body frame and the feed device is determined.

DETAILED DESCRIPTION

Embodiment

Figure 1:
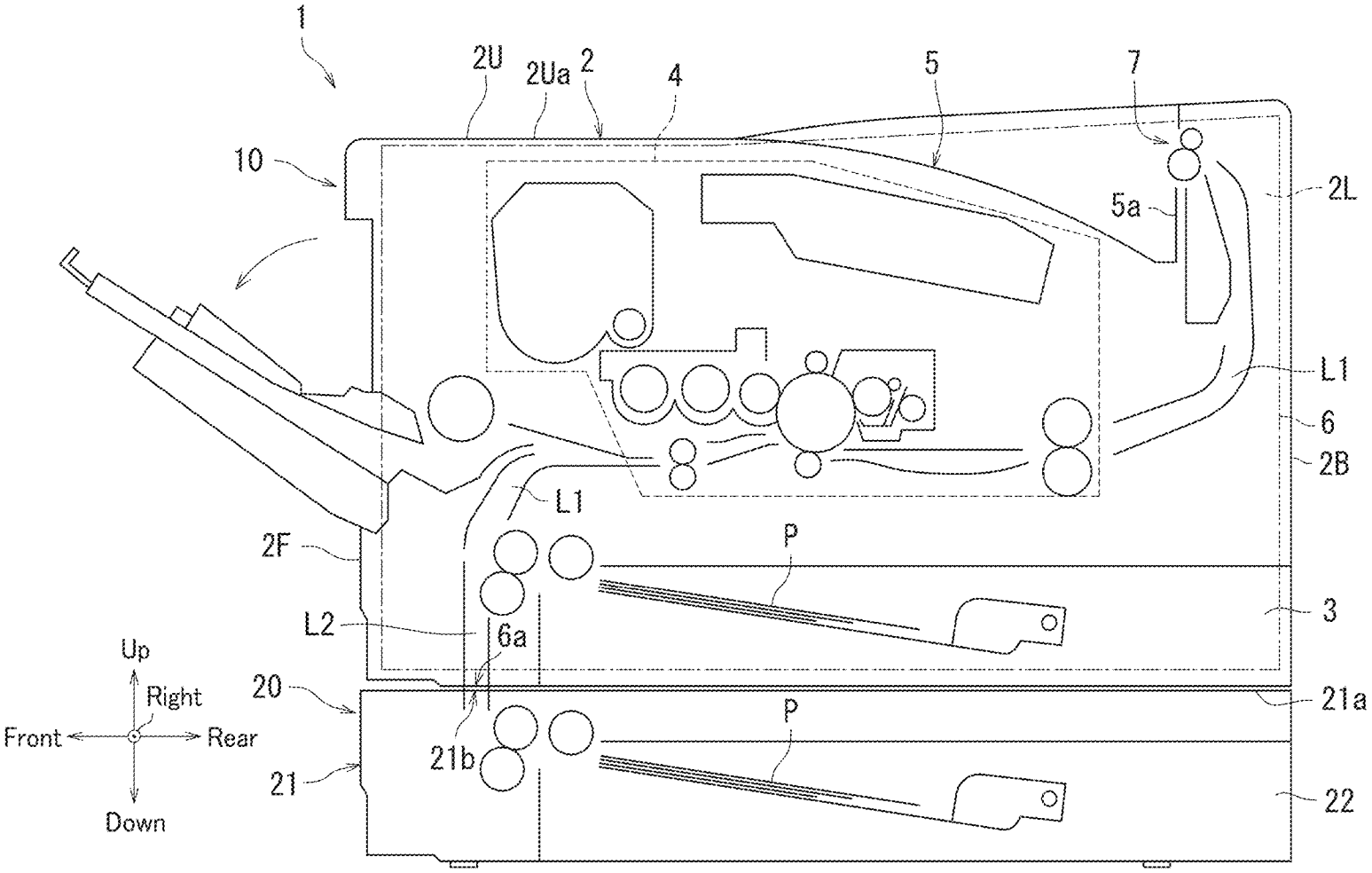
FIG. 1 is a cross-sectional view illustrating configuration of an image forming apparatus according to an embodiment of the present disclosure.

The following explains an embodiment of the present disclosure with reference to the accompanying drawings. Elements in the drawings that are the same or equivalent are marked by the same reference signs. Furthermore, explanation of such elements is not repeated.

First, an image forming apparatus 1 according to an embodiment of the present disclosure will be explained with reference to FIG. 1. FIG. 1 is a cross-sectional view illustrating the image forming apparatus 1.

As illustrated in FIG. 1, the image forming apparatus 1 is for example a printer and forms an image on paper P (a recording medium). The image forming apparatus 1 includes an apparatus main body 10 and a paper feed device 20 (feed device).

The apparatus main body 10 forms an image on the paper P. The apparatus main body 10 includes an exterior cover 2, a paper feed cassette 3, an image forming section 4, an exit tray 5, a main body frame 6, a paper conveyance path L1, and a paper conveyance path L2.

The exterior cover 2 accommodates the paper feed cassette 3, the image forming section 4, the main body frame 6, the paper conveyance path L1, and the paper conveyance path L2. The exterior cover 2 has for example a rectangular parallelepiped box shape. The exterior cover 2 includes a front wall 2F, a rear wall 2B, a left wall 2L, a right wall, and an upper wall 2U. The left wall 2L is located in the rear of the drawing surface in a direction perpendicular to the drawing surface. The right wall is located in front of the drawing surface in the direction perpendicular to the drawing surface. Sides of the front wall 2F, the rear wall 2B, the left wall 2L, and the right wall may be referred to as a front side, a rear side, a left side, and a right side, respectively.

The paper P is ejected onto the exit tray 5. The exit tray 5 is recessed in an upper surface 2Ua of the upper wall 2U of the exterior cover 2. The exit tray 5 has a rear end portion 5*a* in which a paper ejection port 7 is formed. The paper ejection port 7 is an opening through which the paper P is ejected out of the exterior cover 2 onto the exit tray 5.

The paper conveyance path L1 guides the paper P from the paper feed cassette 3 to the paper ejection port 7 via the image forming section 4. The paper feed cassette 3 feeds the paper P to the image forming section 4 through the paper conveyance path L1. The image forming section 4 forms an image on the paper P. The paper P having been subjected to image formation by the image forming section 4 is conveyed to the paper ejection port 7 through the paper conveyance path L1. The paper P is then ejected onto the exit tray 5 from the paper ejection port 7.

The main body frame 6 constitutes a framework of the image forming apparatus 1. The main body frame 6 supports the image forming section 4. The main body frame 6 is located in the interior of the exterior cover 2. A paper inlet 6*a* is formed in the lower surface of the main body frame 6. The paper inlet 6*a* is an opening through which the paper P is conveyed from the paper feed device 20 to the apparatus main body 10.

The paper conveyance path L2 guides the paper P from the paper inlet 6*a* to the paper conveyance path L1. The paper P having been guided to the paper conveyance path L1 through the paper conveyance path L2 is ejected onto the exit tray 5 from the paper ejection port 7 through the paper conveyance path L1 via the image forming section 4.

The paper feed device 20 feeds the paper P to the apparatus main body 10. The paper feed device 20 is detachably attached to the apparatus main body 10. Specifically, the paper feed device 20 is detachably attached below the lower surface of the apparatus main body 10 so as to feed the paper P to the paper inlet 6*a*.

The paper feed device 20 includes an paper feed device exterior cover 21 and a paper feed cassette 22. The paper feed device exterior cover 21 accommodates the paper feed cassette 22. The paper feed device exterior cover 21 has an upper surface 21*a* in which a paper outlet 21*b* is formed. The paper feed cassette 22 feeds the paper P to the paper inlet 6*a* of the apparatus main body 10 from the paper outlet 21*b*.

Figure 2:
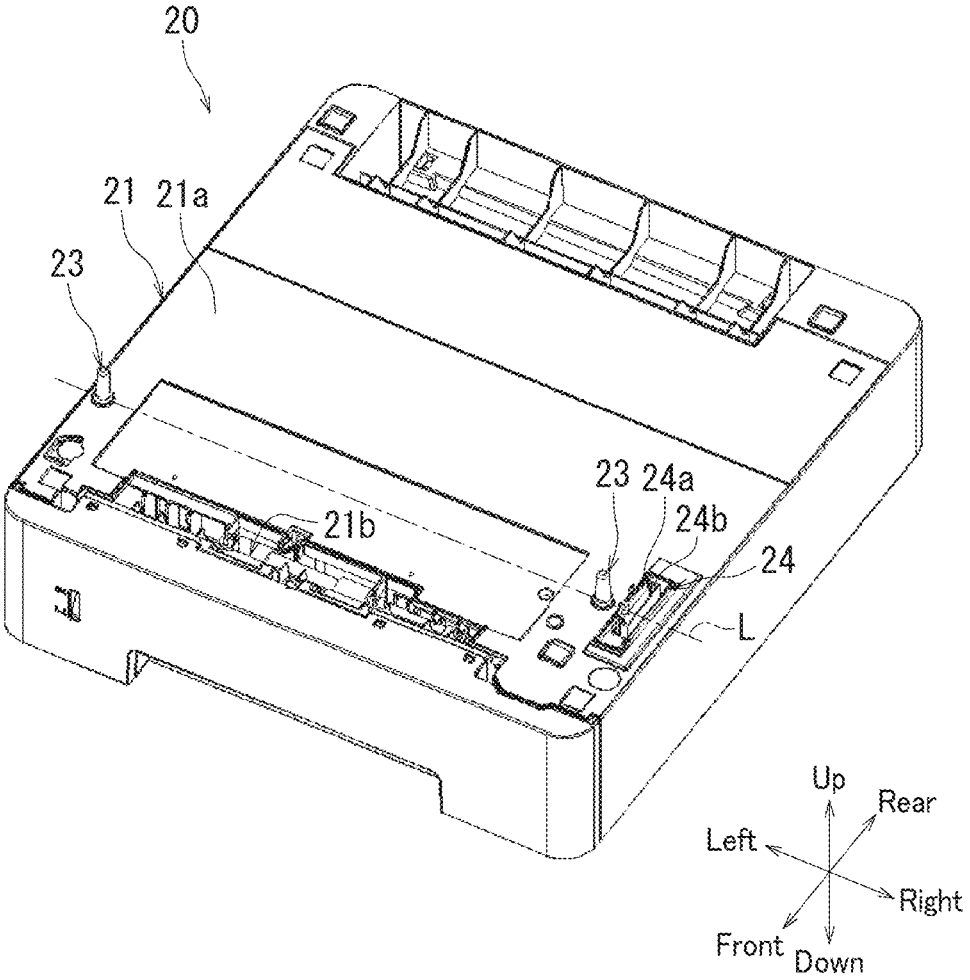
FIG. 2 is a perspective view illustrating a paper feed device.

The paper feed device 20 will be described with reference to FIG. 2. FIG. 2 is a perspective view illustrating the paper feed device 20.

As illustrated in FIG. 2, the paper feed device 20 includes positioning protrusions 23 (positioning targets or protrusions) and a drawer connector 24 (first connector).

The paper feed device exterior cover 21 has for example a substantially flat parallelepiped box shape. The upper surface 21*a* (fitting surface) of the paper feed device exterior cover 21 is detachably attached to the apparatus main body 10 described with reference to FIG. 1.

The positioning protrusions 23 determine a relative positional relationship between the paper feed device 20 and the main body frame 6 described with reference to FIG. 1. The positioning protrusions 23 each are for example a bar-shaped pin. The positioning protrusions 23 stand on respective peripheral edges of the upper surface 21*a* of the paper feed device exterior cover 21. Specifically, the positioning protrusions 23 are paired right and left positioning protrusions 23 that are disposed on right and left front ends of the upper surface 21*a* of the paper feed device exterior cover 21.

Electric power supplied to a driving device (including for example a motor) of the paper feed device 20 is input to the drawer connector 24. The drawer connector 24 is connected to a connector of the apparatus main body 10.

The drawer connector 24 has an oblong rectangular shape (for example, a substantially rectangle shape) in plan. The drawer connector 24 is disposed along a peripheral edge of the upper surface 21*a* of the paper feed device exterior cover 21. Specifically, the drawer connector 24 is disposed in the vicinity of one (for example, right one) of the right and left positioning protrusions 23 on the upper surface 21*a* of the paper feed device exterior cover 21. The drawer connector 24 is disposed for example in the front-to-rear direction of the paper feed device exterior cover 21.

The right and left positioning protrusions 23 each are located on an imaginary straight line L. The imaginary straight line L is a straight line perpendicular to long sides 24*a* among the long sides 24*a* and short sides 24*b* of the drawer connector 24 in plan. In FIG. 2, the right positioning protrusion 23 of the right and left positioning protrusions is disposed adjacent to a left long side 24*a* of the drawer connector 24. Note that the right positioning protrusion 23 may be disposed adjacent to a right long side 24*a* of the drawer connector 24.

The right and left positioning protrusions 23 each are located on the imaginary straight line L. In the above configuration, a situation can be prevented in which the drawer connector 24 comes off from the apparatus main body 10 described with reference to FIG. 1 before the positioning protrusions 23 come off from the apparatus main body 10 upon the apparatus main body 10 inclining back and forth on the upper surface 21*a* of the paper feed device 20. As a result, a situation in which an unnecessary load is applied to the drawer connector 24 can be prevented.

Figure 3:
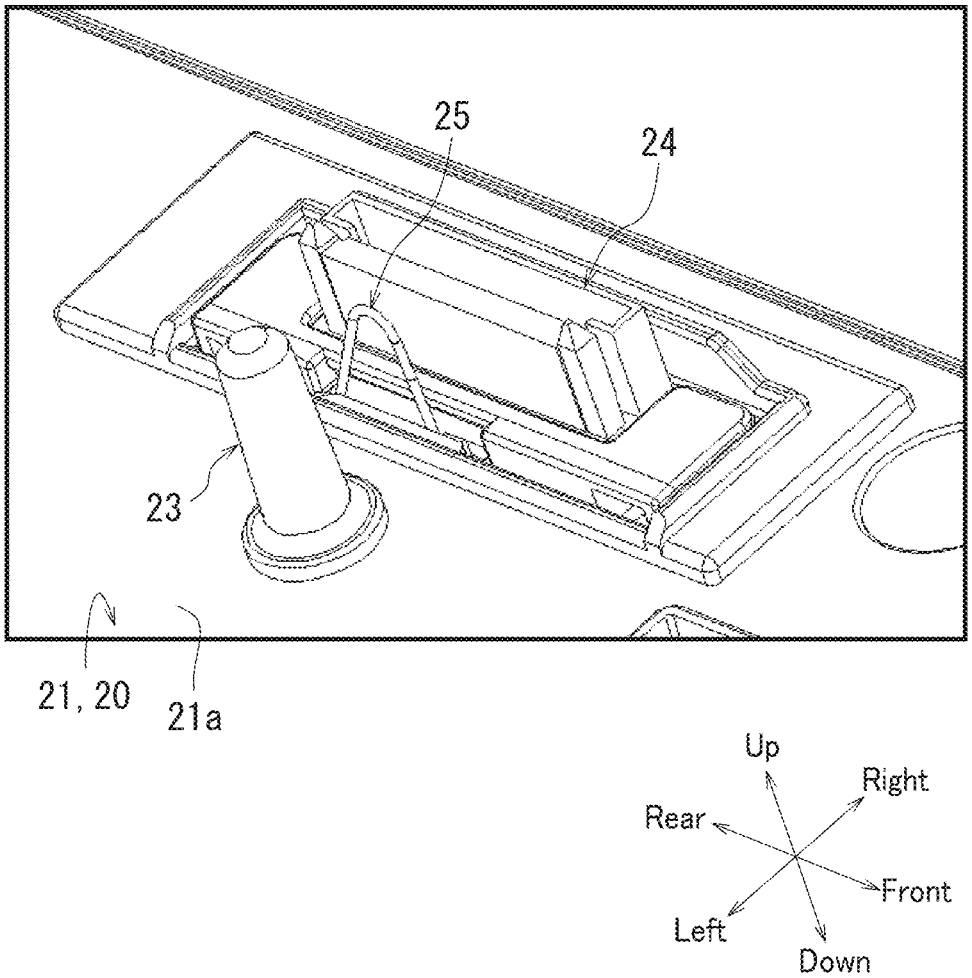
FIG. 3 is a perspective view illustrating a vicinity of a drawer connector.

The paper feed device 30 will be further described with reference to FIG. 3. FIG. 3 is a perspective view illustrating the vicinity of the drawer connector 24 of the paper feed device 20.

As illustrated in FIG. 3, the paper feed device 20 further includes a ground pin 25.

The ground pin 25 is for example formed from a linear conductive member and has a shape protruding upward (for example, an inverted V shape). The ground pin 25 is disposed on the paper feed device exterior cover 21 so as to protrude upward from the upper surface 21*a* of the paper feed device exterior cover 21.

Figure 4:
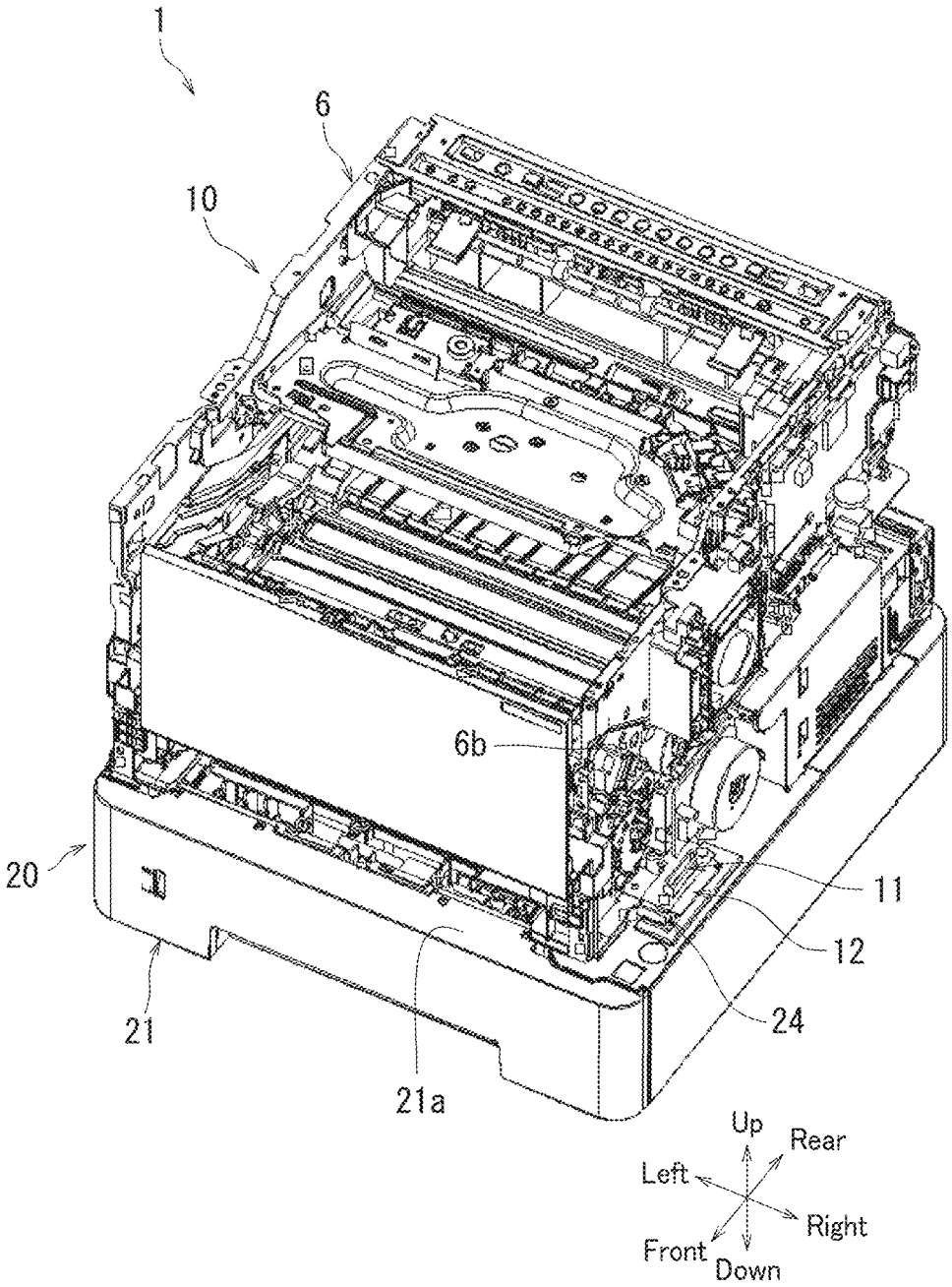
FIG. 4 is a perspective view illustrating the image forming apparatus.

The apparatus main body 10 will be described with reference to FIG. 4. FIG. 4 is a perspective view illustrating the image forming apparatus 1. The exterior cover 2 described with reference to FIG. 1 is not illustrated in FIG. 4.

As illustrated in FIG. 4, the apparatus main body 10 further includes a connector 11 (second connector) and a connector mounting piece 12.

The connector 11 supplies to the drawer connector 24 electric power that is to be supplied to the paper feed device 20. The connector 11 is detachably connected to the drawer connector 24 of the paper feed device 20.

The connector mounting piece 12 supports the connector 11. The connector mounting piece 12 is disposed on the main body frame 6 such as to protrude sideways from the main body frame 6. Specifically, the connector mounting piece 12 is disposed on a lower part of one side surface 6*b* (for example, a side surface on the right side) among outer circumferential side surfaces of the main body frame 6 and protrudes perpendicularly to the side surface 6*b*.

Figure 5:
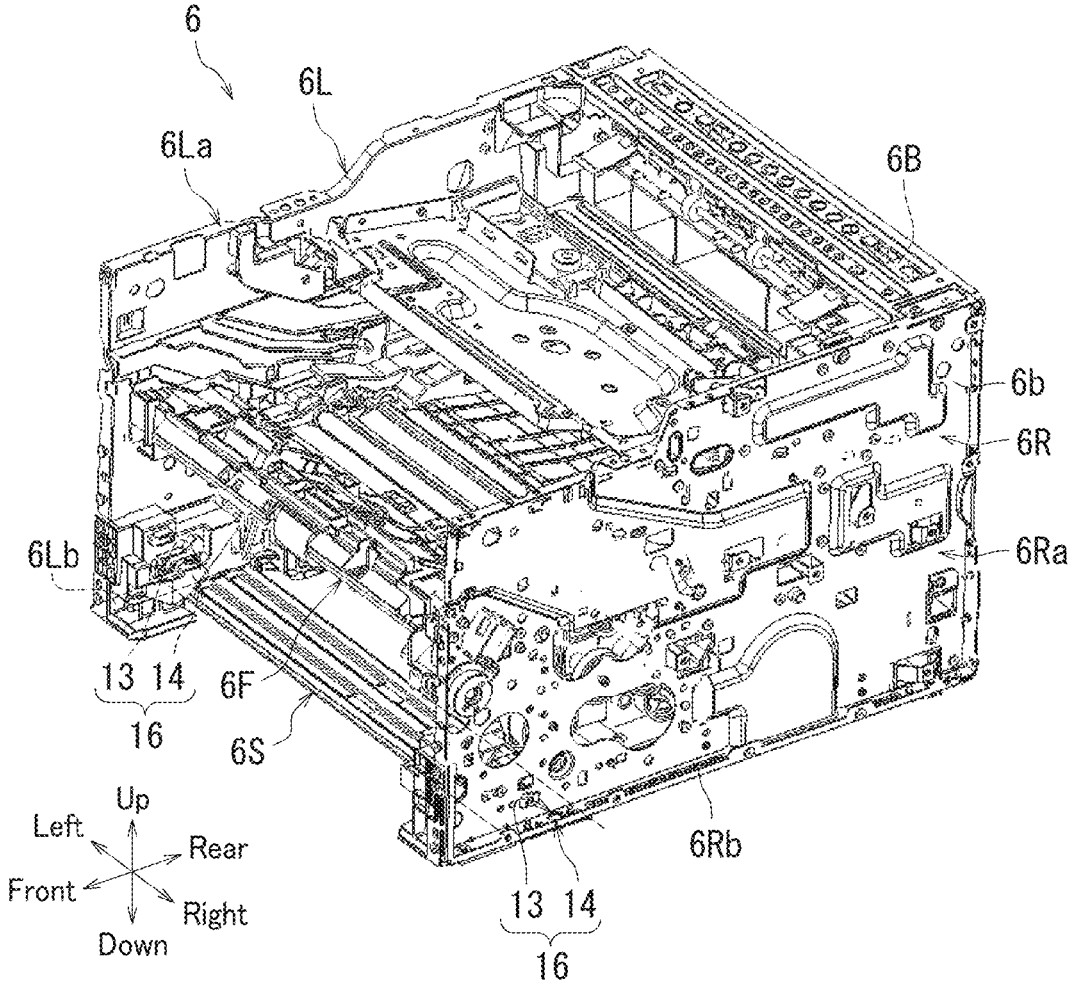
FIG. 5 is a perspective view illustrating a main body frame.

The main body frame 6 will be described with reference to FIG. 5. FIG. 5 is a perspective view illustrating the main body frame 6. The connector mounting piece 12 and the connector 11 described with reference to FIG. 4 are not illustrated in FIG. 5.

As illustrated in FIG. 5, the main body frame 6 includes a left frame 6L (frame side wall), a right frame 6R (frame side wall), a front frame 6F, a rear frame 6B, and a bottom frame 6S.

The left frame 6L is disposed on the interior side (reverse side) of the left wall 2L of the exterior cover 2 described with reference to FIG. 1. The right frame 6R is located on the interior side of the right wall of the exterior cover 2. The right and left frames 6R and 6L have substantially the same flat plate shapes and substantially the same dimensions as the right and left walls 2R and 2L of the exterior cover 2, respectively. In the example described with reference to FIG. 5, the right and left frames 6R and 6L each have a rectangle plate shape.

The front frame 6F is joined to respective front edges of the right and left frames 6R and 6L. The rear frame 6B is joined to respective rear edges of the right and left frames 6R and 6L. The bottom frame 6S is disposed at an open bottom of the exterior cover 2 and joined to respective lower edges of the right and left frames 6R and 6L.

The right frame 6R includes a right frame main body 6Ra (frame side wall main body) and a flange 6Rb.

The flange 6Rb is joined to the bottom frame 6S. The flange 6Rb is located on a lower edge of the right frame main body 6Ra and extends in a longitudinal direction of the lower edge of the right frame main body 6Ra (i.e., a front-to-rear direction of the image forming apparatus 1). The flange 6Rb protrudes sideways from an outer main surface (side surface 6*b* of the main body frame 6 described with reference to FIG. 4) of main surfaces on the opposite sides of the right frame main body 6Ra. The side surface 6*b* will be also referred to below as an outer main surface 6*b*. The left frame 6L includes a left frame main body 6La (frame side wall main body) and a flange 6Lb, similarly to the right frame 6R.

The bottom frame 6S has a right end joined to the flange 6Rb of the right frame 6R below the flange 6Rb. The bottom frame 6S has a left end joined to the flange 6Lb of the left frame 6L below the flange 6Lb.

The main body frame 6 has positioning holes 16 (positioning portions or holes). The positioning holes 16 determines the relative positional relationship between the main body frame 6 and the paper feed device 20. The positioning holes 16 are located in the main body frame 6 (i.e., a framework portion of the apparatus main body 10). As such, an error in the relative positional relationship between the main body frame 6 and the paper feed device 20 is not so great in the above configuration as compared with that in a configuration in which the positioning holes 16 are located in a guide member mounted on the main body frame 6.

The positioning holes 16 are paired right and left positioning holes 16 respectively located on the right and left sides of the main body frame 6. Specifically, the respective positioning holes 16 are located on a joint part between the right frame 6R and the bottom frame 6S and a joint part between the left frame 6L and the bottom frame 6S.

The joint part between the right frame 6R and the bottom frame 6S and the joint part between the left frame 6L and the bottom frame 6S each are a part of the main body frame 6 that has the highest strength in the main body frame 6. In the above configuration in which the respective positioning holes 16 are located at the joint part between the right frame 6R and the bottom frame 6S and the joint part between the left frame 6L and the bottom frame 6S, an error in the relative positional relationship between the main body frame 6 and the paper feed device 20 can be reduced further.

The right and left positioning holes 16 each include a first positioning hole wall portion 13 (first hole) and a second positioning hole wall portion 14 (second hole).

Figure 6:
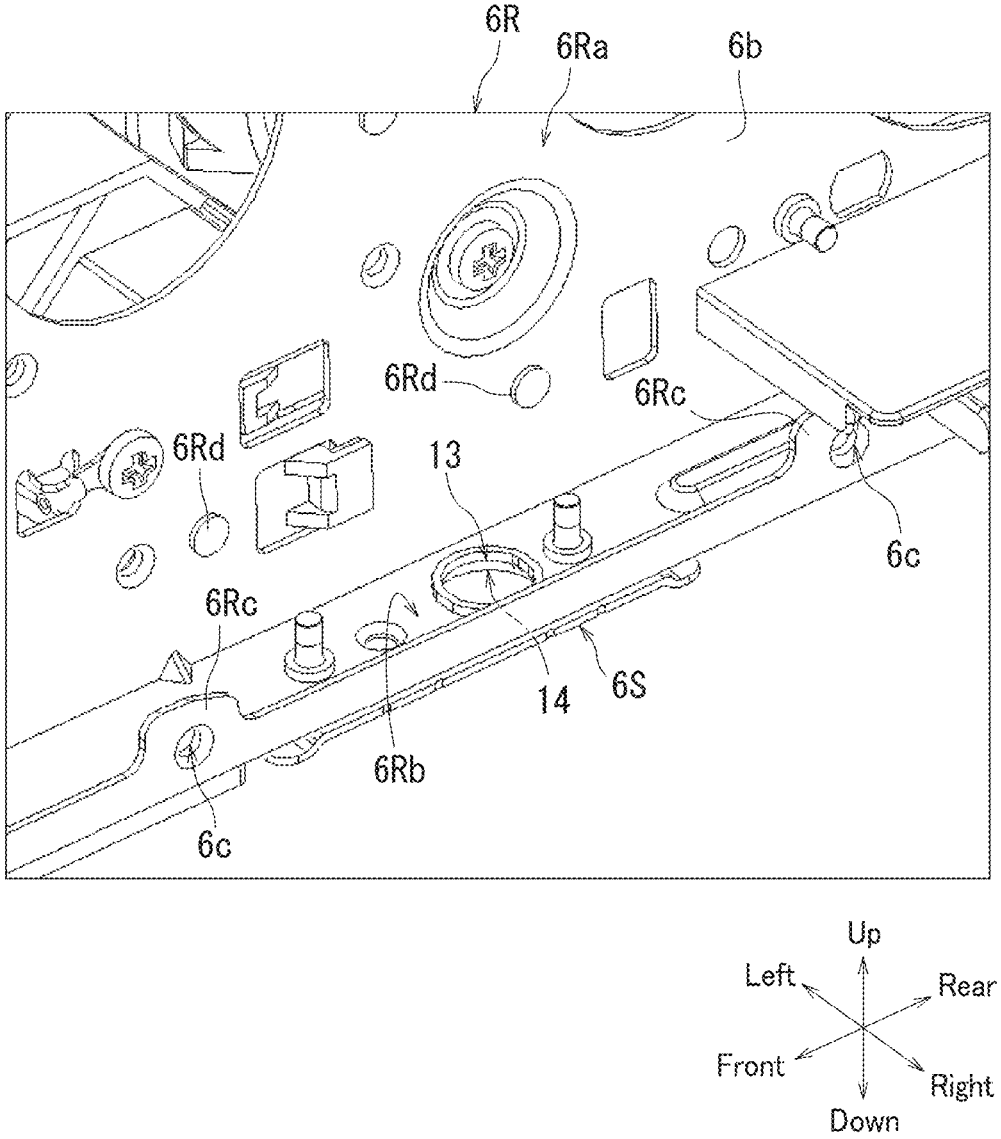
FIG. 6 is a perspective view illustrating a flange of a right frame.

The first positioning hole wall portion 13 will be described with reference to FIG. 6. FIG. 6 is a perspective view illustrating the flange 6Rb of the right frame 6R. The connector 11 and the connector mounting piece 12 described with reference to FIG. 4 are not illustrated in FIG. 6.

As illustrated in FIG. 6, the first positioning hole wall portion 13 of the right positioning hole 16 is located at a part of the flange 6Rb of the right frame 6R that is joined to the bottom frame 6S. Though not illustrated, the first positioning hole wall portion 13 of the left positioning hole 16 is located at a part of the flange 6Lb of the left frame 6L that is joined to the bottom frame 6S.

A description will be made next with reference to FIG. 6 about mounting structure of the connector mounting piece 12 on the right frame 6R. The connector mounting piece 12 is not illustrated in FIG. 6. The first positioning hole wall portions 13 are burred. As a result of burring, an inner wall surface that stands upward from the flange 6Rb is formed as the right first positioning hole wall portion 13. Though not shown, an inner wall surface that stands upward from the flange 6Lb is formed likewise as the left first positioning hole wall portion 13.

As illustrated in FIG. 6, the right frame 6R further includes a pair of fastening portions 6Rc and 6Rc and a pair of positioning protrusions 6Rd and 6Rd.

The connector mounting piece 12 described with reference to FIG. 4 is fastened to the right frame 6R at the pair of fastening portions 6Rc and 6Rc. The pair of fastening portions 6Rc and 6Rc stands upward from a tip end of the flange 6Rb in a short direction (i.e., left-right direction of the image forming apparatus 1). The fastening portions 6Rc and 6Rc are spaced apart from each other. The first positioning hole wall portion 13 of the positioning hole 16 in the flange 6Rb of the right frame 6R is located between the pair of fastening portions 6Rc and 6Rc.

The fastening portions 6Rc and 6Rc each include a screwed part 6*c*. A screw is screwed into the screwed part 6*c*. The screw fastens the connector mounting piece 12 to the right frame 6R.

The pair of positioning protrusions 6Rd and 6Rd determines a relative positional relationship between the right frame 6R and the connector mounting piece 12. The positioning protrusions 6Rd and 6Rd each have for example a flat columnar shape. The pair of positioning protrusions 6Rd and 6Rd protrudes from the outer main surface 6*b* of the opposite main surfaces of the right frame main body 6Ra. The positioning protrusions 6Rd and 6Rd are arranged side by side in the front-to-rear direction of the image forming apparatus 1.

Figure 7:
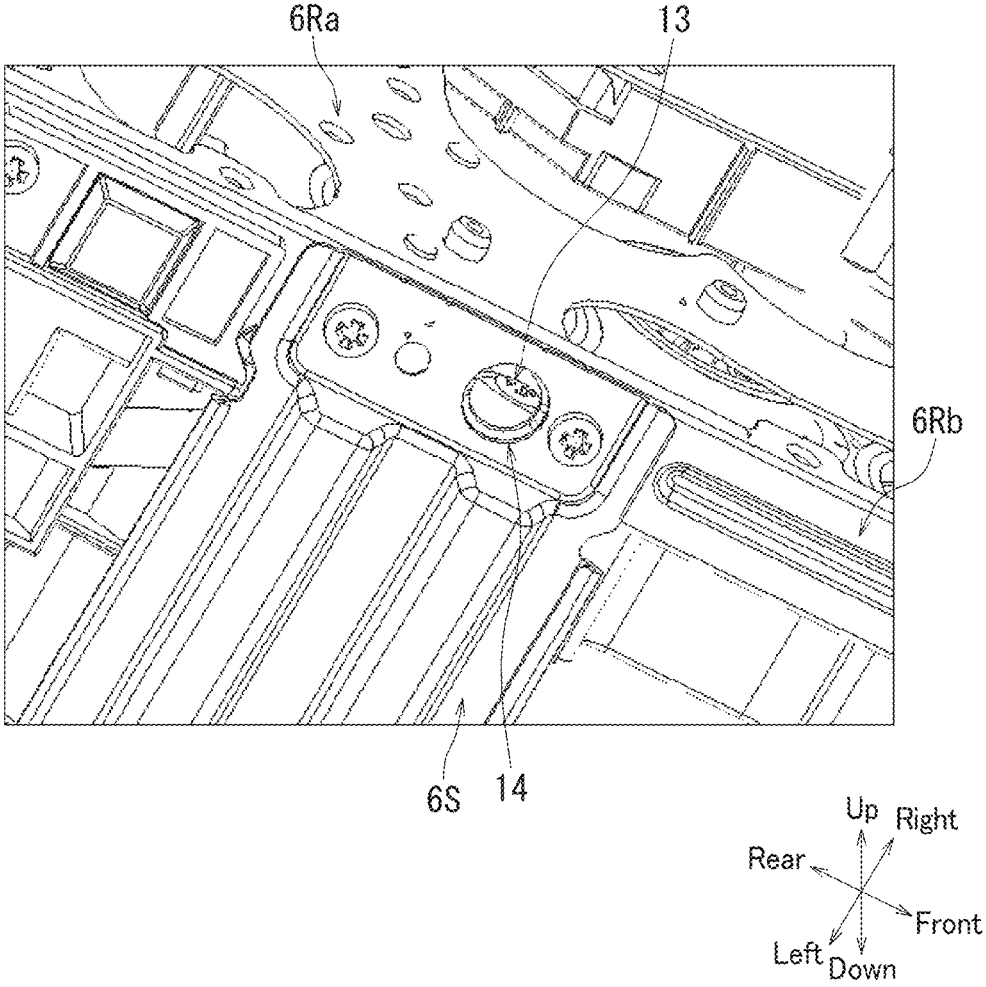
FIG. 7 is a perspective view of a right end of a frame bottom wall as viewed from below.

The second positioning hole wall portion 14 of the positioning hole 16 in the right frame 6R will be described with reference to FIG. 7. FIG. 7 is a perspective view of a right end of the bottom frame 6S as viewed from below.

As illustrated in FIG. 7, the second positioning hole wall portion 14 of the right positioning hole 16 of the right and left positioning holes 16 is located at a part of the bottom frame 6S that is joined to the flange 6Rb of the right frame 6R. The second positioning hole wall portion 14 of the right positioning hole 16 continues to the first positioning hole wall portion 13 of the right positioning hole 16 of the right and left positioning holes 16. That is, the first positioning hole wall portion 13 of the right positioning hole 16 is locate on the second positioning hole wall portion 14 of the right positioning hole 16. The second positioning hole wall portion 14 has a larger diameter than the first positioning hole wall portion 13. Specifically, the diameter of the second positioning hole wall portion 14 is slightly larger than that of the first positioning hole wall portion 13. The peripheral edge of the first positioning hole wall portion 13 juts inward of the second positioning hole wall portion 14. The first positioning hole wall portion 13 precisely determines the relative positional relationship between the main body frame 6 and the paper feed device 20. The second positioning hole wall portion 14 roughly determines the relative positional relationship between the main body frame 6 and the paper feed device 20.

Figure 8:
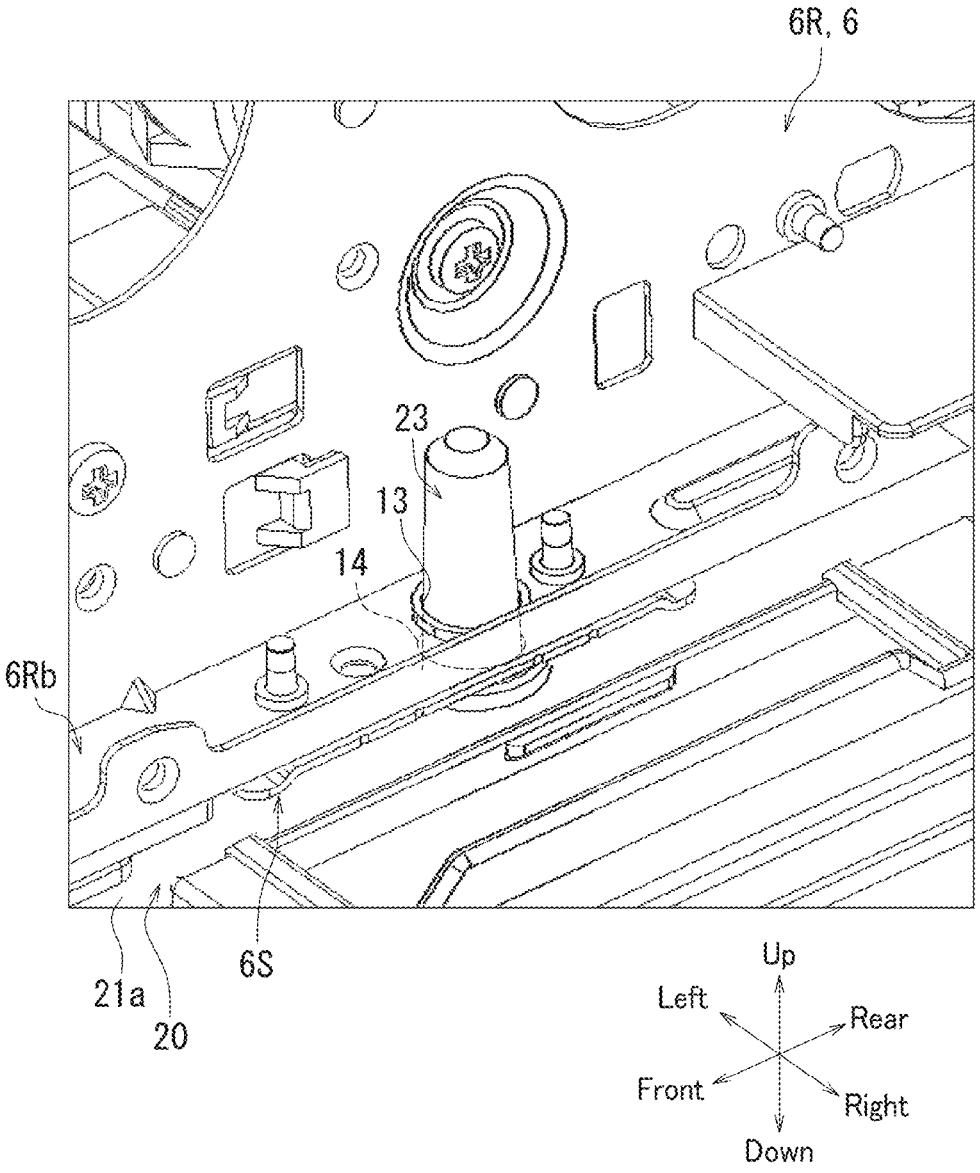
FIG. 8 is a perspective view illustrating the flange of the right frame.
Figure 9:
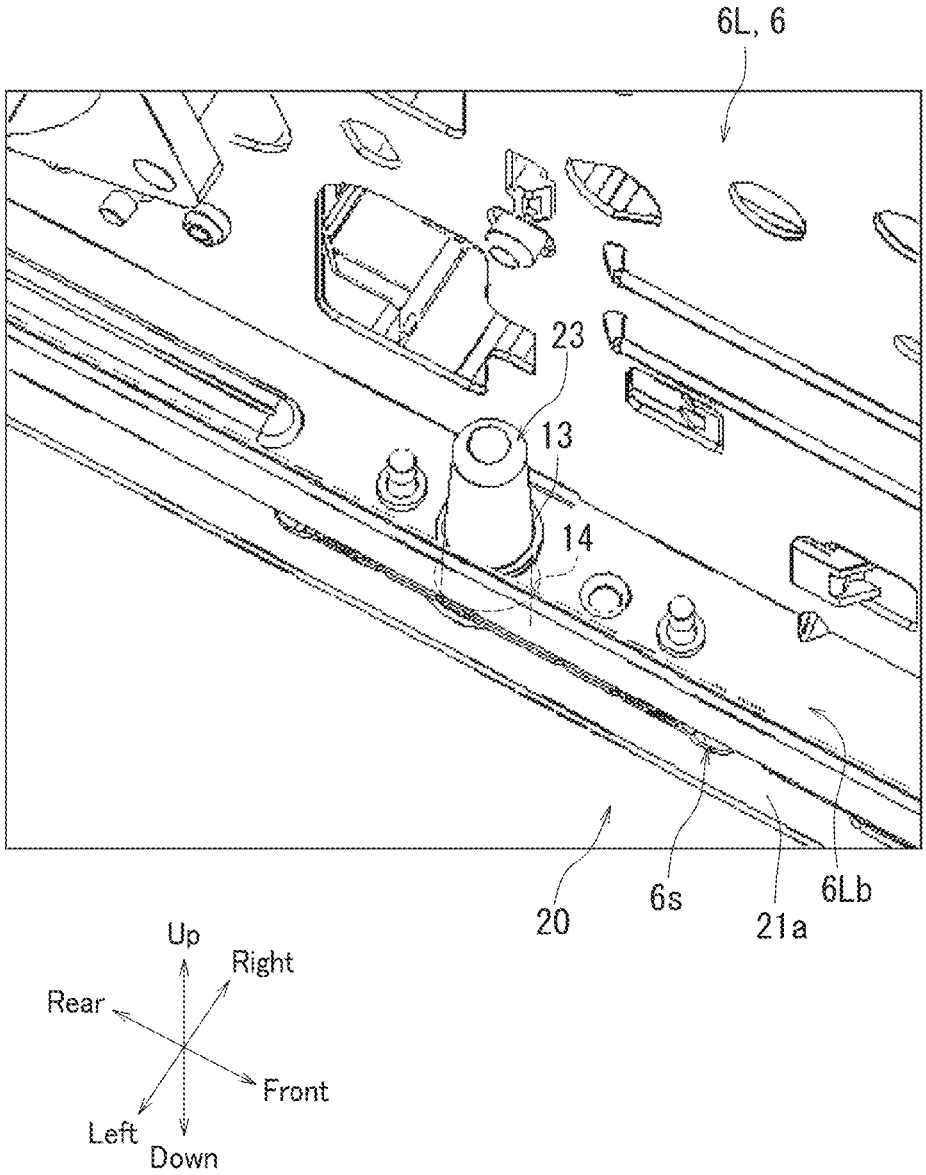
FIG. 9 is a perspective view illustrating a flange of a left frame.

Following describes a manner of engagement of the positioning protrusions 23 with the respective first and second positioning hole wall portions 13 and 14 with reference to FIGS. 8 and 9. FIG. 8 is a perspective view illustrating the flange 6Rb of the right frame 6R. The connector 11 and the connector mounting piece 12 described with reference to FIG. 4 are not illustrated in FIG. 8. FIG. 9 is a perspective view illustrating the flange 6Lb of the left frame 6L.

As illustrated in FIG. 8, when the upper surface 21*a* of the paper feed device 20 is attached to the main body frame 6, the right positioning protrusion 23 of the right and left positioning protrusions 23 is inserted (fitted) into the second positioning hole wall portion 14 and the first positioning hole wall portion 13 of the right positioning hole 16 of the right and left positioning holes 16 sequentially in the stated order.

As illustrated in FIG. 9, when the upper surface 21*a* of the paper feed device 20 is attached to the main body frame 6, the left positioning protrusion 23 of the right and left positioning protrusions 23 is inserted (fitted) into the second positioning hole wall portion 14 and the first positioning hole wall portion 13 of the left positioning hole 16 of the right and left positioning holes 16 sequentially in the stated order.

Insertion of the right and left positioning protrusions 23 into the respective second positioning hole wall portions 14 of the right and left positioning holes 16 can result in rough determination of the relative positional relationship between the main body frame 6 and the paper feed device 20. Insertion of the right and left positioning protrusions 23 into the respective first positioning hole wall portions 13 of the right and left positioning holes 16 can result in precise determination of the relative positional relationship between the main body frame 6 and the paper feed device 20. Furthermore, in a configuration in which the first positioning hole wall portions 13 are burred, the positioning protrusions 23 can be inserted smoothly into the respective first positioning hole wall portions 13 without being shaven.

Figure 10:
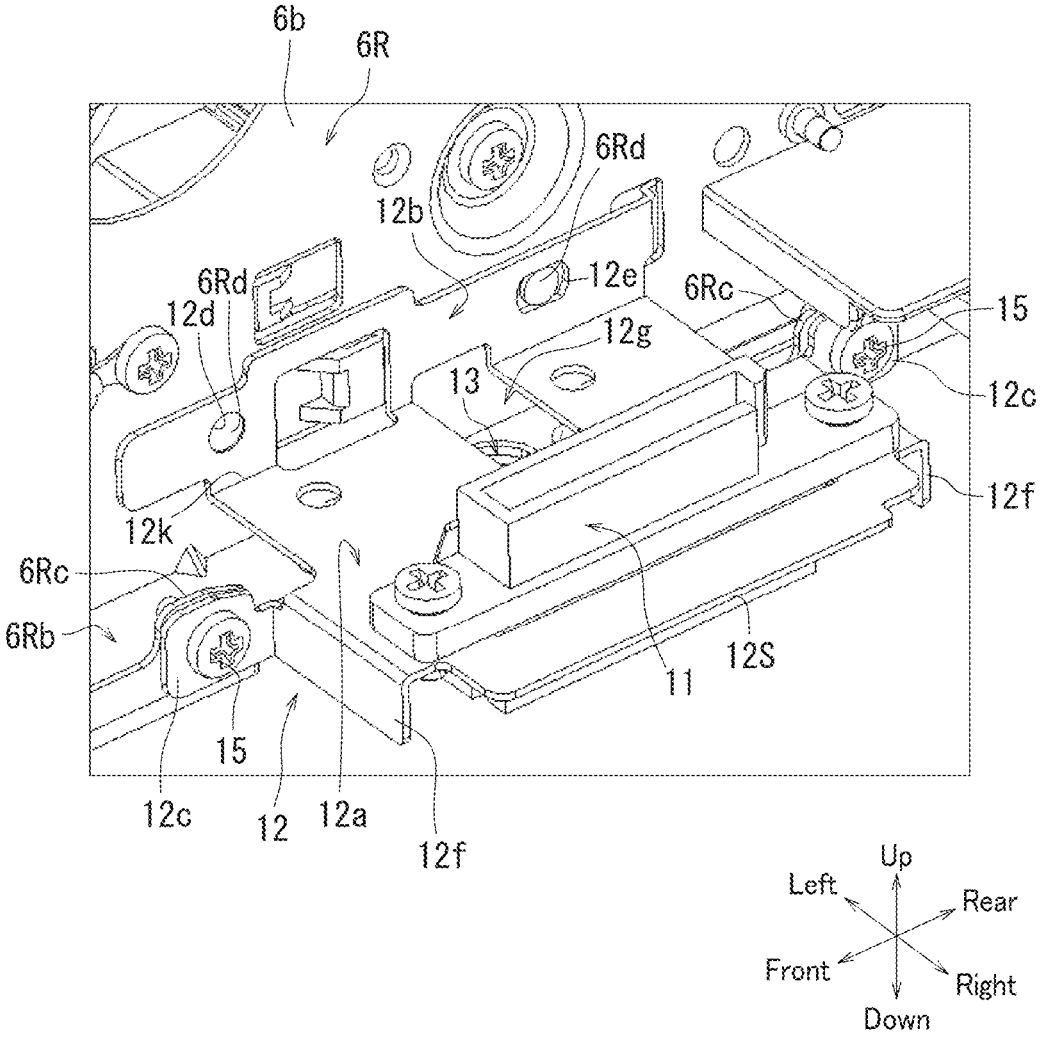
FIG. 10 is a perspective view illustrating a connector mounting piece.
Figure 11:
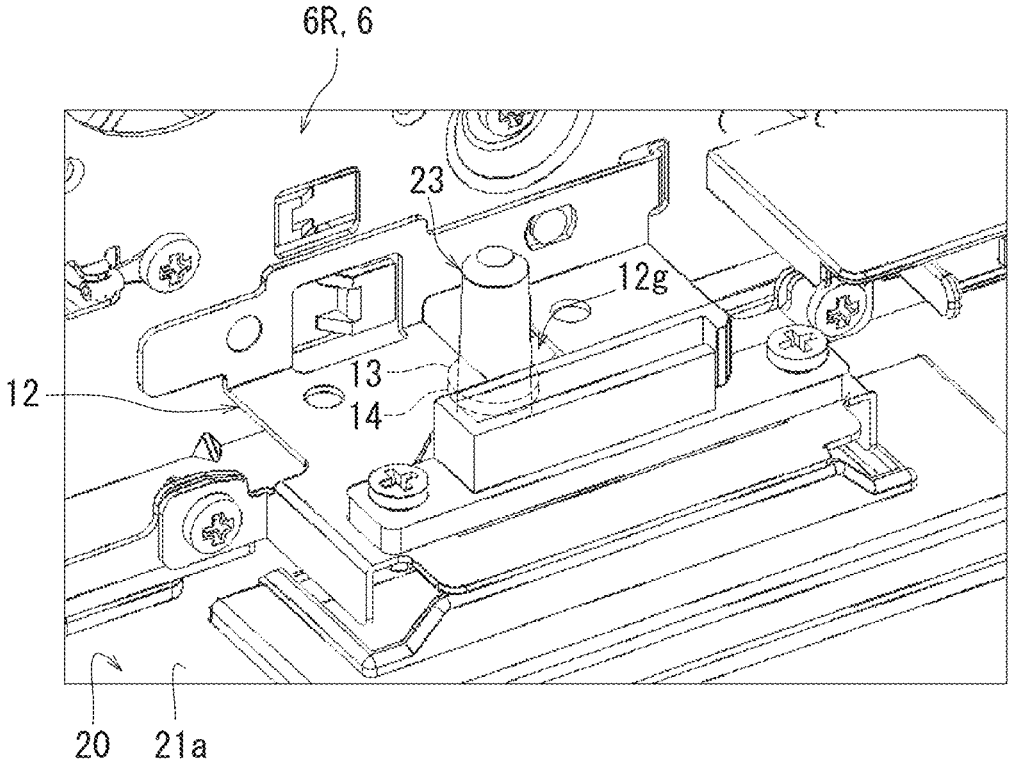
FIG. 11 is a perspective view illustrating the connector mounting piece.

The connector mounting piece 12 will be described with reference to FIGS. 10 and 11. FIGS. 10 and 11 each are a perspective view illustrating the connector mounting piece 12. The paper feed device 20 is attached to the main body frame 6 in FIG. 11 and not attached to the main body frame 6 in FIG. 10.

As illustrated in FIG. 10, the connector mounting piece 12 is disposed on the right frame 6R. The connector mounting piece 12 has a tip end part 12*s* protruding sideways of the outer main surface 6*b* of the opposite main surfaces of the right frame 6R.

The image forming apparatus 1 includes a pair of screws 15 and 15. The pair of screws 15 and 15 connects the connector mounting piece 12 to the right frame 6R.

The connector mounting piece 12 is formed of a conductive member (for example, a metal). The connector mounting piece 12 includes a connector mounting piece main body 12*a*, a flange portion 12*b*, and a pair of fastening portions 12*c* and 12*c*.

The connector mounting piece main body 12*a* has a substantially rectangular plate shape. The connector mounting piece main body 12*a* is upwardly spaced apart from the first positioning hole wall portion 13. The connector mounting piece main body 12*a* is parallel to the flange 6Rb and perpendicular to the outer main surface 6*b* of the right frame main body 6Ra.

Of a tip end half and a base end half of the connector mounting piece main body 12*a*, the tip end half protrudes outward (i.e., rightward) beyond the flange 6Rb. The connector 11 is mounted on the tip end half of the connector mounting piece main body 12*a*.

The connector mounting piece main body 12*a* has an opening 12*g*. The opening 12*g* has for example a substantially rectangular shape in section. The opening 12*g* is located in a part of the connector mounting piece main body 12*a* that is opposite to the first positioning hole wall portion 13 of the right positioning hole 16.

The flange portion 12*b* is in contact with the outer main surface 6*b* of the right frame main body 6Ra. The flange portion 12*b* has a substantially rectangular plate shape. The flange portion 12*b* is located at a base end part 12*k* of the connector mounting piece main body 12*a* and protrudes upward. The flange portion 12*b* extends in a longitudinal direction of the base end part 12*k* (i.e., the front-to-rear direction of the image forming apparatus 1).

The flange portion 12*b* has positioning holes 12*d* and 12*e*.

The positioning holes 12*d* and 12*e* engage with the paired positioning protrusions 6Rd and 6Rd, respectively. The above engagement determines the relative positional relationship between the right frame 6R and the connector mounting piece 12. The positioning holes 12*d* and 12*e* are spaced apart from each other in the longitudinal direction of the flange portion 12*b*.

The positioning hole 12*d* has an open end plane in a circular shape. The positioning hole 12*e* has an open end plane in a substantially oblong rectangular shape. Specifically, the positioning hole 12*e* extends in the longitudinal direction of the flange portion 12*b* in plan. The positioning hole 12*d* determines a position of the connector mounting piece 12 on the outer main surface 6*b* in the vertical direction and the transverse direction. The positioning hole 12*e* determines a position of the connector mounting piece 12 on the outer main surface 6*b* in the vertical direction.

The fastening portions 12*c* and 12*c* are located on the respective opposite sides of the connector mounting piece main body 12*a* and protrude therefrom. The opposite sides of the connector mounting piece main body 12*a* means opposite sides of the connector mounting piece main body 12*a* in a longitudinal direction of the flange 6Rb (i.e., the front-to-rear direction of the image forming apparatus 1).

Specifically, the connector mounting piece main body 12*a* has a pair of bent portions 12*f* and 12*f*. The bent portions 12*f* and 12*f* are located at respective opposite edges of the tip end half of the connector mounting piece main body 12*a*. The pair of bent portions 12*f* and 12*f* protrudes downward from the connector mounting piece main body 12*a*. The fastening portions 12*c* and 12*c* are located at edges of the bent portions 12*f* and 12*f* on a side of the flange 6Rb, respectively. The fastening portions 12*c* and 12*c* protrude from the respective opposite edges of the connector mounting piece main body 12*a*.

The respective fastening portions 12*c* and 12*c* have through holes. The screws 15 and 15 are inserted into the through holes of the fastening portions 12*c* and 12*c*, respectively, to be in screw engagement with the screwed parts 6*c* and 6*c* of the fastening portions 6Rc and 6Rc described with reference to FIG. 6. Through the above screw engagement, the connector mounting piece 12 is fastened to the right frame 6R.

As illustrated in FIG. 11, when the upper surface 21*a* of the paper feed device 20 is attached to the main body frame 6, the positioning protrusions 23 of the paper feed device 20 are inserted into the first and second positioning hole wall portions 14 and 13 of the respective positioning holes 16 of the main body frame 6 and the opening 12*g* of the connector mounting piece 12 sequentially in the stated order. The opening 12*g* can prevent the positioning protrusions 23 from being displaced from the main body frame 6 beyond a predetermined range.

Figure 12:
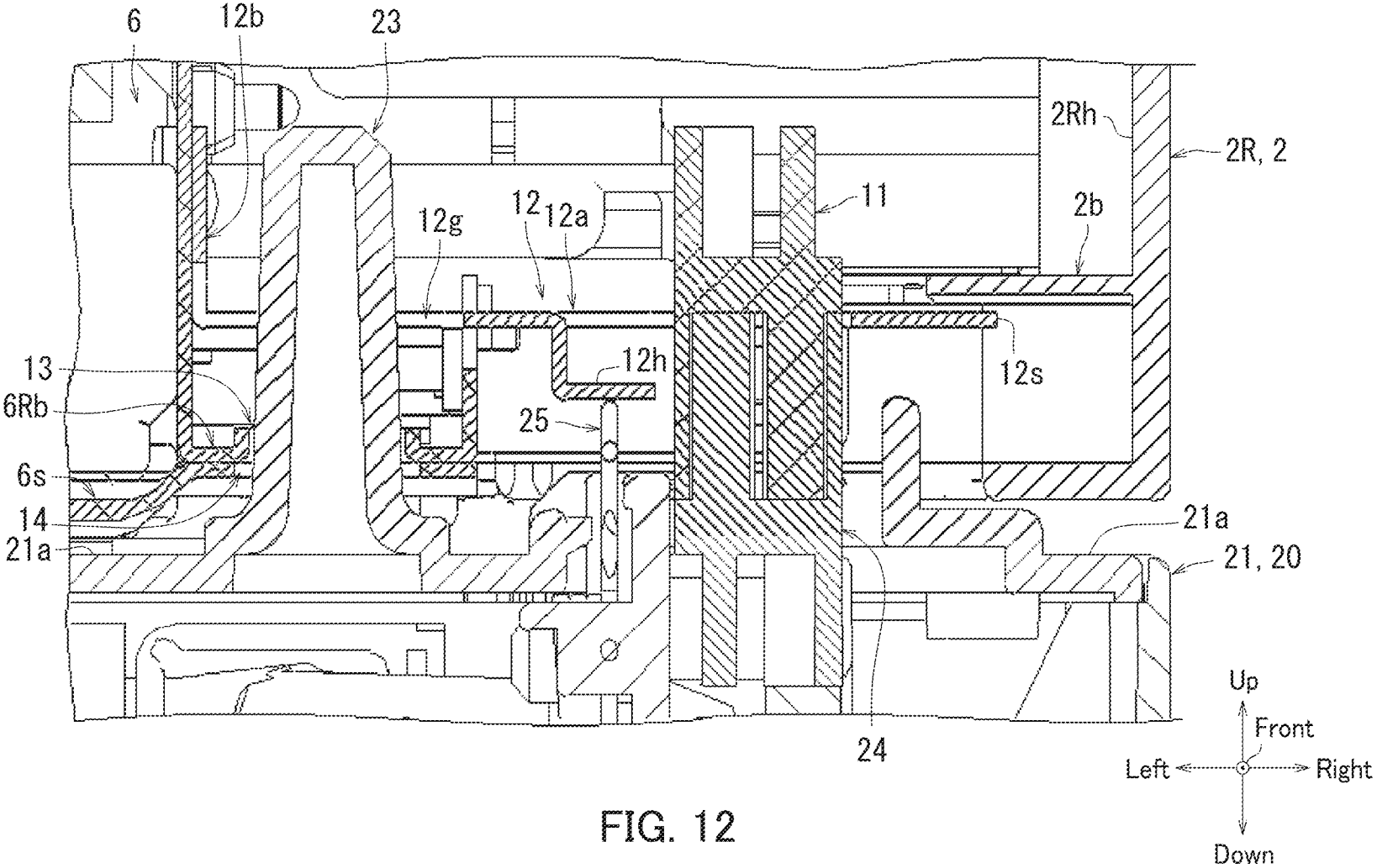
FIG. 12 is a perspective view illustrating a vicinity of the connector mounting piece.

The connector mounting piece 12 will be further described with reference to FIG. 12. FIG. 12 is a cross-sectional view illustrating the vicinity of the connector mounting piece 12 in the image forming apparatus 1. Specifically, FIG. 12 is a cross-sectional view illustrating the vicinity of the connector mounting piece 12 in section perpendicular to the front-to-rear direction of the image forming apparatus 1.

As illustrated in FIG. 12, the exterior cover 2 includes a protrusion 2*b*. The protrusion 2*b* is located above and adjacent to the tip end part 12*s* of the connector mounting piece 12. In the above configuration, when the connector mounting piece 12 is pushed upward by the drawer connector 24, the tip end part 12*s* comes in contact with the protrusion 2*b*. The above configuration can accordingly prevent the connector mounting piece 12 from being bent upward.

The protrusion 2*b* is located on the inner main surface 2Rh of the right frame main body 6Ra of the right wall 2R of the exterior cover 2 and protrudes inward of the exterior cover 2.

The connector 11 is disposed through the tip end half of the connector mounting piece main body 12*a* and protrudes downward of the connector mounting piece main body 12*a*.

The connector mounting piece main body 12*a* further has a contact portion 12*h*. The contact portion 12*h* is in contact with the ground pin 25 in a conductive manner. The contact portion 12*h* is located between the opening 12*g* and the connector 11. The contact portion 12*h* protrudes for example downward in a stepwise fashion from the lower surface of the connector mounting piece main body 12*a*. In the above configuration, the ground pin 25 comes in contact with the contact portion 12*h* before the drawer connector 24 of the paper feed device 20 is connected to the connector 11.

Once the paper feed device 20 is attached to the main body frame 6, the drawer connector 24 of the paper feed device 20 is connected to the connector 11. Furthermore, the ground pin 25 of the paper feed device 20 comes in contact with the contact portion 12*h* of the connector mounting piece 12 in a conductive manner. Through the above contact, the ground pin 25 is electrically connected to the main body frame 6 via the connector mounting piece 12.

Moreover, the ground pin 25 is disposed between the drawer connector 24 and the right positioning protrusion 23. In the above configuration, the ground pin 25 can be prevented from separating from the contact portion 12*h* of the connector mounting piece 12 before the drawer connector 24 separates from the connector 11 in a situation in which the apparatus main body 10 described with reference to FIG. 1 inclines frontward or rearward on the upper surface 21*a* of the paper feed device 20.

Figure 13:
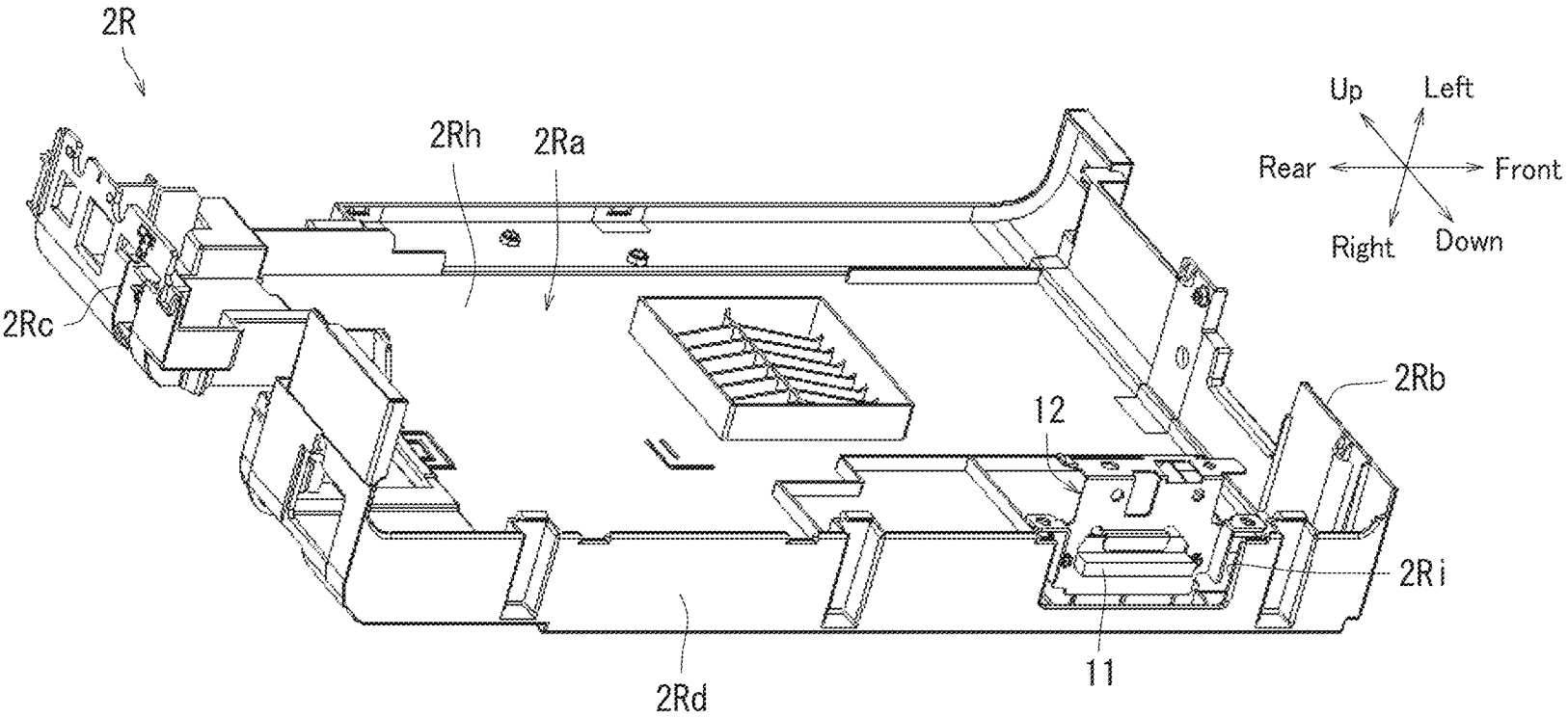
FIG. 13 is a perspective view of a right wall of an exterior cover as viewed from below.

The exterior cover 2 will be described with reference to FIG. 13. FIG. 13 is a perspective view of the right wall 2R of the exterior cover 2 as viewed from below.

The right wall 2R of the exterior cover 2 includes a right wall main body 2Ra, a front frame 2Rb, a rear frame 2Rc, and a frame bottom wall 2Rd.

The front frame 2Rb, the rear frame 2Rc, and the frame bottom wall 2Rd are disposed at a front end, a rear end, and a lower end of the right wall main body 2Ra, respectively, and protrude inward of the inner main surface 2Rh of the right wall main body 2Ra.

The frame bottom wall 2Rd has a notch 2Ri. The notch 2Ri exposes the connector mounting piece 12 under of the frame bottom wall 2Rd. The notch 2Ri has a rectangular shape. The notch 2Ri is located at a front end of the frame bottom wall 2Rd.

The frame bottom wall 2Rd is located adjacent to and along the flange 6Rb described with reference to FIG. 5 on the outer side (that is, right side) of the flange 6Rb. The notch 2Ri is located below the connector mounting piece 12. In the above configuration, the connector 11 mounted on the connector mounting piece 12 is exposed through the notch 2Ri at the lower side of the main body frame 6. Formation of the notch 2Ri as above enables connection between the connector 11 disposed on the main body frame 6 and the drawer connector 24 described with reference to FIG. 2.

Through the above, an embodiment of the present disclosure has been described with reference to the drawings (FIGS. 1-13). However, the present disclosure is of course not limited to the embodiment described above and may be implemented in various different forms so long as such implementations do not deviate from the intended scope of the present disclosure (for example, the following alteration). The drawings are schematic illustrations that emphasize elements of configuration in order to facilitate understanding thereof. Therefore, in order that the elements can be easily illustrated in the drawings, properties of each of the elements, such as thickness, length, and number thereof, may differ from actual properties of the element. Material properties, shapes, dimensions, etc. of elements of configuration in the above embodiment are merely examples that do not impose any particular limitations and can be altered in various ways to the extent that there is not substantial deviation from the effects of the present disclosure.

<Alteration>

The respective positioning holes 16 in the above embodiment are located at the joint part between the right frame 6R and the bottom frame 6S and the joint part between the left frame 6L and the bottom frame 6S. However, the respective positioning holes 16 may be located at any parts other than the joint part between the right frame 6R and the bottom frame 6S and the joint part between the left frame 6L and the bottom frame 6S. In the above configuration, the second positioning hole wall portions 14 are not formed and the positioning holes 16 include only the respective first positioning hole wall portion 13.

What is claimed is:

1. An image forming apparatus comprising:

an apparatus main body; and a feed device detachably attached to the apparatus main body and configured to feed a recording medium to the apparatus main body, wherein the apparatus main body includes an image forming section configured to form an image on the recording medium and a main body frame that supports the image forming section, the main body frame has a positioning portion, the feed device has a position target portion, when the positioning portion is fitted into the positioning target, a relative positional relationship between the main body frame and the feed device is determined, the main body frame of the apparatus main body includes a frame side wall, the frame side wall includes a frame side wall main body and a flange, the flange protrudes from a lower end of the frame side wall main body on a main surface of opposite main surfaces of the frame side wall main body, the positioning portion of the main body frame is located at the flange, the main body frame of the apparatus main body further includes a frame bottom wall joined to the frame side wall of the main body frame, the positioning portion of the main body frame is located at a part of the frame side wall of the main body frame that is joined to the frame bottom wall, the positioning portion of the main body frame of the apparatus main body is a hole portion, the positioning target of the feed device is a protrusion, the hole portion includes a first hole and a second hole in communication with the first hole, the first hole is located at the part of the frame side wall of the main body frame that is joined to the frame bottom wall, the second hole wall portion is located at a part of the frame bottom wall that is joined to the frame bottom wall of the main body frame, and the second hole has a larger diameter than the first hole.

2. The image forming apparatus according to claim 1, wherein the feed device has a fitting surface to which the main body frame of the apparatus main body is detachably attached and includes a first connector disposed at an edge of the fitting surface, the apparatus main body further includes a second connector connected to the first connector, and the positioning target of the feed device is located adjacent to the first connector.

3. The image forming apparatus according to claim 2, wherein the first connector of the feed device has an oblong rectangular shape in plane that extends along an edge of the fitting surface of the feed device, and the positioning target of the feed device is located adjacent to the end of the first connector in a short direction of the oblong rectangular shape of the first connector in plane.

4. The image forming apparatus according to claim 2, wherein the positioning portion of the main body frame is a hole, the positioning target of the feed device is a protrusion, the apparatus main body further includes a connector mounting piece on which the second connector of the apparatus main body is mounted, the connector mounting piece has an opening, and the positioning target is inserted into the opening.

5. An image forming apparatus comprising:

an apparatus main body; and a feed device detachably attached to the apparatus main body and configured to feed a recording medium to the apparatus main body, wherein the apparatus main body includes an image forming section configured to form an image on the recording medium and a main body frame that supports the image forming section, the main body frame has a positioning portion, the feed device has a position target portion, when the positioning portion is fitted into the positioning target, a relative positional relationship between the main body frame and the feed device is determined, the feed device has a fitting surface to which the main body frame of the apparatus main body is detachably attached and includes a first connector disposed at an edge of the fitting surface, the apparatus main body further includes a second connector connected to the first connector, the positioning target of the feed device is located adjacent to the first connector, the positioning portion of the main body frame is a hole, the positioning target of the feed device is a protrusion, the apparatus main body further includes a connector mounting piece on which the second connector of the apparatus main body is mounted, the connector mounting piece has an opening, the positioning target is inserted into the opening, the apparatus main body further includes an exterior cover, the exterior cover includes a protrusion protruding inward of the exterior cover, the connector mounting piece of the apparatus main body of the apparatus main body is disposed on the main body frame such that a tip end of the connector mounting piece protrudes sideways from the main body frame, and the tip end of the connector mounting piece is located below and adjacent to the protrusion of the apparatus main body.

6. An image forming apparatus comprising:

an apparatus main body; and a feed device detachably attached to the apparatus main body and configured to feed a recording medium to the apparatus main body, wherein the apparatus main body includes an image forming section configured to form an image on the recording medium and a main body frame that supports the image forming section, the main body frame has a positioning portion, the feed device has a position target portion, when the positioning portion is fitted into the positioning target, a relative positional relationship between the main body frame and the feed device is determined, the feed device has a fitting surface to which the main body frame of the apparatus main body is detachably attached and includes a first connector disposed at an edge of the fitting surface, the apparatus main body further includes a second connector connected to the first connector, the positioning target of the feed device is located adjacent to the first connector, the positioning portion of the main body frame is a hole, the positioning target of the feed device is a protrusion, the apparatus main body further includes a connector mounting piece on which the second connector of the apparatus main body is mounted, the connector mounting piece has an opening, the positioning target is inserted into the opening, the connector mounting piece of the apparatus main body is conductive, the feed device further includes a ground pin, and the ground pin is disposed between the positioning target and the first connector of the feed device such as to be in contact with the connector mounting piece in a conductive manner.

7. The image forming apparatus according to claim 6, wherein the connector mounting piece of the apparatus main body includes a connector mounting piece main body having a contact portion, and the contact portion is in contact with the ground pin of the feed device in a conductive manner, and protrudes downward in a stepwise fashion from a lower surface of the connector mounting piece main body.

8. The image forming apparatus according to claim 5, wherein the exterior cover of the apparatus main body includes a frame right wall and a frame bottom wall disposed along a lower edge of the frame right wall, the frame bottom wall has a notch in a front end of the frame bottom wall, and the notch is located below the connector mounting piece of the apparatus main body.

9. The image forming apparatus according to claim 4, further comprising screws, wherein the frame side wall includes a pair of first fastening portions, each including a screwed part, the connector mounting piece of the apparatus main body includes a pair of second fastening portions each having a through hole, and the screws are inserted into the respective through holes to be screwed into the respective screwed parts.

10. The image forming apparatus according to claim 5, further comprising screws, wherein the main body frame of the apparatus main body includes a frame side wall, the frame side wall includes a pair of first fastening portions, each including a screwed part, the connector mounting piece of the apparatus main body includes a pair of second fastening portions each having a through hole, and the screws are inserted into the respective through holes to be screwed into the respective screwed parts.

11. The image forming apparatus according to claim 6, further comprising screws, wherein the main body frame of the apparatus main body includes a frame side wall, the frame side wall includes a pair of first fastening portions, each including a screwed part, the connector mounting piece of the apparatus main body includes a pair of second fastening portions each having a through hole, and the screws are inserted into the respective through holes to be screwed into the respective screwed parts.

* * * * *